US008616687B2

(12) United States Patent
Takagi et al.

(10) Patent No.: US 8,616,687 B2
(45) Date of Patent: Dec. 31, 2013

(54) CARTRIDGE AND METHOD OF MANUFACTURING THEREOF

(75) Inventors: Yuki Takagi, Nagoya (JP); Toyonori Sasaki, Anjo (JP); Tomohiro Kanbe, Nagoya (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/618,252

(22) Filed: Sep. 14, 2012

(65) Prior Publication Data

US 2013/0162730 A1 Jun. 27, 2013

(30) Foreign Application Priority Data

Dec. 22, 2011 (JP) ..... 2011-282157

(51) Int. Cl.
*B41J 2/175* (2006.01)

(52) U.S. Cl.
USPC ..... 347/86

(58) Field of Classification Search
USPC ..... 347/19, 85, 86, 87; 345/50
See application file for complete search history.

(56) References Cited

U.S. PATENT DOCUMENTS

| | | | | |
|---|---|---|---|---|
| 5,652,608 | A | 7/1997 | Watanabe et al. | |
| 5,661,510 | A | 8/1997 | Brandon et al. | |
| 5,748,210 | A | 5/1998 | Watanabe et al. | |
| 5,861,897 | A | 1/1999 | Ide et al. | |
| 5,975,688 | A | 11/1999 | Kanaya et al. | |
| 6,074,042 | A | 6/2000 | Gasvoda et al. | |
| 6,312,088 | B1 | 11/2001 | Seino | |
| 6,416,152 | B1 | 7/2002 | Matsuzaki et al. | |
| 6,502,917 | B1 * | 1/2003 | Shinada et al. | 347/19 |
| 7,784,923 | B2 * | 8/2010 | Ishizawa et al. | 347/85 |
| 8,123,343 | B2 * | 2/2012 | Shinada et al. | 347/86 |
| 8,297,739 | B1 * | 10/2012 | Kodama et al. | 347/49 |
| 2002/0015067 | A1 | 2/2002 | Studholme et al. | |
| 2003/0156160 | A1 | 8/2003 | Yamaguchi et al. | |
| 2004/0183870 | A1 | 9/2004 | Steinmetz et al. | |
| 2005/0146576 | A1 | 7/2005 | Shinada et al. | |

(Continued)

FOREIGN PATENT DOCUMENTS

| | | | |
|---|---|---|---|
| EP | 0581298 | A2 | 2/1994 |
| EP | 0713778 | A2 | 5/1996 |

(Continued)

OTHER PUBLICATIONS

European Patent Office, Extended European Search Report for European Patent Application No. 12185826.0 (related to above-captioned patent application), mailed Oct. 23, 2013.

*Primary Examiner* — Anh T. N. Vo
(74) *Attorney, Agent, or Firm* — Baker Botts L.L.P.

(57) ABSTRACT

A cartridge includes a main body with a chamber formed therein that receives an imaging material, a circuit board having at least one opening formed through the circuit board; and an electrode disposed on the circuit board. The main body includes a support surface that supports the circuit board, a first protrusion protruding from the support surface and that contacting a first surface of the circuit board. The first surface of the circuit board extends in a direction perpendicular to the support surface. The main body also includes a second protrusion protruding from the support surface and disposed in the at least one opening. The second protrusion includes an end portion that covers a portion of the circuit board. In addition, a method for manufacturing the cartridge.

12 Claims, 7 Drawing Sheets

(56) References Cited

U.S. PATENT DOCUMENTS

| | | | |
|---|---|---|---|
| 2005/0195255 | A1 | 9/2005 | Shinada et al. |
| 2006/0033790 | A1 | 2/2006 | Shinada et al. |
| 2006/0119677 | A1 | 6/2006 | Shinada et al. |
| 2006/0139393 | A1 | 6/2006 | Zhang et al. |
| 2006/0203050 | A1 | 9/2006 | Shinada et al. |
| 2006/0219726 | A1 | 10/2006 | Yajima et al. |
| 2006/0250426 | A1 | 11/2006 | Wanibe et al. |
| 2006/0250446 | A1 | 11/2006 | Wanibe et al. |
| 2006/0251430 | A1 | 11/2006 | Wanibe et al. |
| 2007/0247501 | A1 | 10/2007 | Shinada et al. |
| 2008/0284830 | A1 | 11/2008 | Shinada et al. |
| 2009/0009560 | A1 | 1/2009 | Shinada et al. |
| 2009/0027453 | A1 | 1/2009 | Shinada et al. |
| 2009/0040274 | A1 | 2/2009 | Shinada et al. |
| 2009/0040275 | A1 | 2/2009 | Shinada et al. |
| 2011/0273520 | A1 | 11/2011 | Shinada et al. |

FOREIGN PATENT DOCUMENTS

| | | | |
|---|---|---|---|
| EP | 1038682 | A1 | 9/2000 |
| EP | 1336493 | A2 | 8/2003 |
| GB | 2354202 | A | 3/2001 |
| GB | 2424623 | A | 10/2006 |
| JP | H08-318621 | A | 12/1996 |
| JP | H09-039265 | A | 2/1997 |
| JP | 2003-054003 | A | 2/2003 |

* cited by examiner

CARTRIDGE AND METHOD OF MANUFACTURING THEREOF

CROSS-REFERENCE TO RELATED APPLICATION

This application claims priority from Japanese Patent Application No. 2011-282157, filed on Dec. 22, 2011, which is incorporated herein by reference.

BACKGROUND OF THE INVENTION

1. Field of the Invention

The invention relates generally to a cartridge comprising an electrical interface and a method of manufacturing the cartridge.

2. Description of Related Art

A known inkjet recording apparatus is configured to record an image onto a recording medium, e.g., a recording sheet, with ink. The known inkjet recording apparatus includes an inkjet-type recording head. The recording head is configured to selectively eject ink, which is supplied from an ink cartridge, from nozzles toward a recording sheet. The ink cartridge is configured to attached to and detached from the known inkjet recording apparatus.

Known ink cartridges are configured to store ink of one of a plurality of colors, e.g., cyan, magenta, yellow and black. The known ink cartridges may store ink having different characteristics, i.e., pigment ink or dye ink. In order to prevent ink mixture or ink solidification, an inkjet recording apparatus may identify the color or characteristics of the ink stored in an ink cartridge attached to the inkjet recording apparatus. For identification of an ink cartridge, the ink cartridge may include a storage device, i.e., an integrated circuit ("IC") chip, that is configured to store information about the ink cartridge, i.e., ink color.

SUMMARY OF TITLE INVENTION

When an IC chip is mounted on an ink cartridge, a certain degree of positioning accuracy may be required. For example, a contact provided in a cartridge mount may contact an electrode of the IC chip of the ink cartridge, even when the ink cartridge mounted in the cartridge mount deviates from its desired or intended position with respect to an ink cartridge inserting direction. When an IC chip includes a plurality of electrodes, each of a plurality of contacts provided in the cartridge mount may contact one of the plurality of electrodes of the IC chip, respectively. The positioning of the IC chip may be implemented through image processing. Nevertheless, assembly of the ink cartridge may become complicated.

The present invention may provide a method for positioning and fixing an electrical interface with respect to a printing liquid cartridge.

The IC chip may be fixed, such that the IC chip does not detach from the ink cartridge or become misaligned due to impact during shipment or due to the ink cartridge falling on a hard surface. Further, the IC chip may be fixed to the ink cartridge with a certain degree of positional accuracy and reliability while reducing manufacturing cost.

According to an embodiment of the invention, a cartridge comprising: a main body having a chamber formed therein and configured to receive an imaging material; a circuit board having at least one opening formed through the circuit board; and an electrode disposed on the circuit board. The main body comprises: a support surface configured to support the circuit board; a first protrusion protruding from the support surface and configured to contact a first surface of the circuit board, wherein the first surface of the circuit board extends in a direction perpendicular to the support surface; and a second protrusion protruding from the support surface and disposed in the at least one opening, wherein the second protrusion comprises an end portion that covers a portion of the circuit board.

According to another embodiment of the invention, a cartridge comprising: a main body having a chamber formed therein and configured to receive an imaging material; a circuit board having a hole and a notch formed through the circuit board; and an electrode disposed on the circuit board, wherein the main body comprises: a support surface configured to support the circuit board; an imaging material outlet portion protruding from a first surface of the main body perpendicular to the support surface and configured to communicate the chamber of the main body with an exterior of the main body; a first protrusion protruding from the support surface and configured to contact a first surface of the circuit board, wherein the first surface of the circuit board extends in a direction perpendicular to the support surface; a second protrusion protruding from the support surface and disposed in the hole, wherein the second protrusion comprises an end portion that covers a portion of the circuit board, a third protrusion protruding from the support surface and disposed in the notch, wherein the electrode of the circuit board is disposed between the second protrusion and the imaging material outlet portion in a direction in which the imaging material output portion protrudes from the first surface of the main body, wherein the first protrusion is disposed between the circuit board and the imaging material outlet portion in the direction in which the imaging material outlet portion protrudes from the first surface of the main body, wherein the first protrusion comprises a first surface parallel to and contacting the first surface of the circuit board, wherein the cartridge further comprises a plurality of electrodes positioned in the circuit board and arranged in a row extending in a direction parallel to the first surface of the circuit board and to the support surface of the main body, and wherein the first protrusion does not overlap the row of the plurality of electrodes in a direction perpendicular to the first surface of the circuit board.

According to still another embodiment of the invention, a method for affixing a circuit board to a support surface of a cartridge, the method comprising: positioning the circuit board on the support surface adjacent to a first protrusion on the support surface, such that a second protrusion disposed on the support surface is positioned in an opening of the circuit board; moving the circuit board toward the first protrusion, such that the circuit board contacts the first protrusion; and heating a portion of the second protrusion to melt the portion of the second protrusion, such that the melted portion of the second protrusion contacts a surface of the circuit board.

Other objects, features, and advantages of an embodiment of the invention will be apparent to persons of ordinary skill in the art from the following description of an embodiment with reference to the accompanying drawings.

BRIEF DESCRIPTION OF THE DRAWINGS

For a more complete understanding of the present invention, needs satisfied thereby, and the objects, features, and advantages thereof, reference now is made to the following descriptions taken in connection with the accompanying drawing.

DETAILED DESCRIPTION OF EMBODIMENTS OF THE INVENTION

Figure 1:
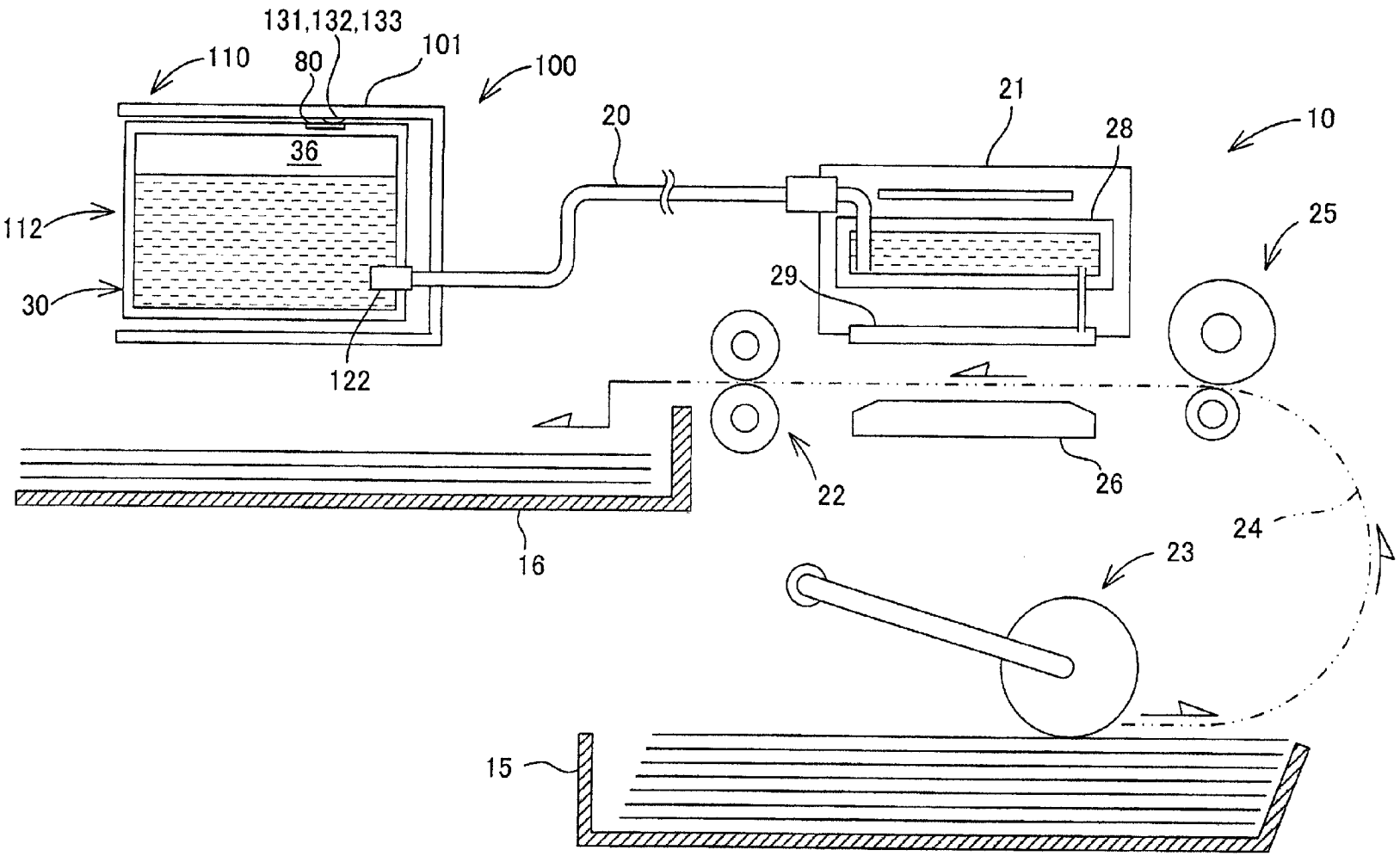
FIG. 1 is a schematic and cross-sectional view depicting an internal configuration of an inkjet recording apparatus according to an embodiment of the invention.

Embodiments of the invention now are described in detail with reference to the accompanying drawings; like reference numerals are used for corresponding parts in the various drawings.

Referring to FIG. 1, a printer 10, e.g., an inkjet recording apparatus, may be configured to record an image on a recording sheet by selectively ejecting ink droplets onto the recording sheet using an inkjet recording system. Printer 10 may comprise an ink supply device 100. Ink supply device 100 may comprise a cartridge mount 110. Cartridge mount 110 may be configured to receive an ink cartridge 30. Cartridge mount 110 may have an opening 12 formed at an open side. Ink cartridge 30, e.g., a cartridge, may be inserted into or removed from cartridge mount 110 selectively via opening 112.

Ink cartridge 30 may be configured to store ink to be used in printer 10. When ink cartridge 30 is mounted to cartridge mount 110, ink cartridge 30 and a recording head 21 may be connected to each other via an ink tube 20. Recording head 21 may comprise a sub tank 28. Sub tank 28 may be configured to temporarily store ink supplied via ink tribe 20 from ink cartridge 30. Recording head 21 may be configured to selectively eject ink, which is supplied from sub tank 28, from nozzles 29.

In printer 10, a feed roller 23 may feed recording sheets one by one from a sheet feed tray 15 to a conveying path 24. A conveyor roller pair 25 may further convey the recording sheet onto a platen 26. Recording head 21 may be configured to selectively eject ink onto the recording sheet that is passing over platen 26 to record an image on the recording sheet. A discharge roller pair 22 then may discharge the recording sheet, which has passed over platen 26, onto a sheet discharge tray 16 disposed at a downstream end of conveying path 24.

As depicted in FIG. 1, printer 10 may comprise ink supply device 100. Ink supply device 100 may be configured to supply ink to recording head 21 of printer 10. Ink supply device 100 may comprise cartridge mount 110, to which ink cartridge 30 may be mounted. As depicted in FIG. 1, ink cartridge 30 may be placed in cartridge mount 110.

Figure 2:
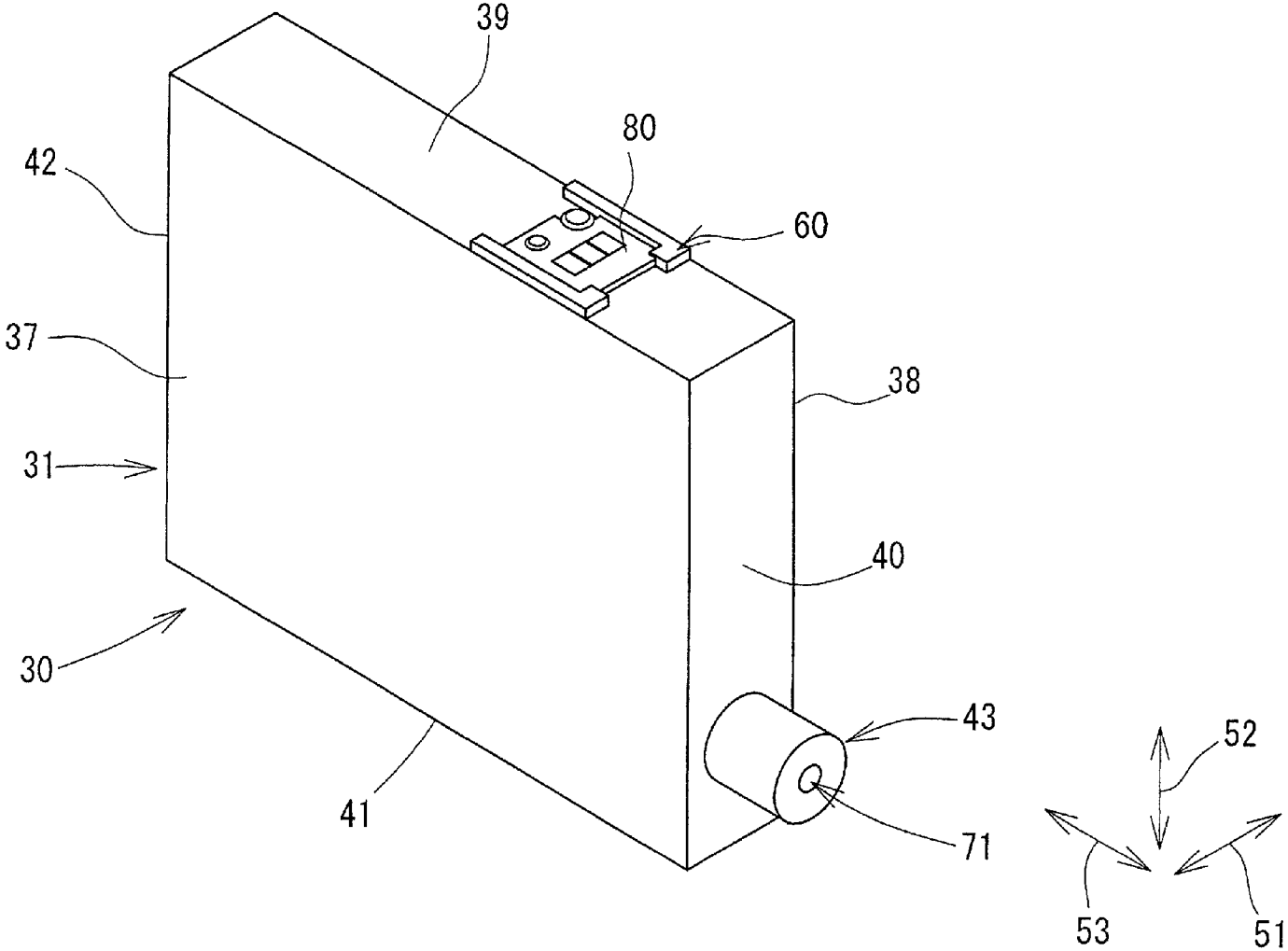
FIG. 2 is a perspective view depicting an ink cartridge according to an embodiment of the invention.
Figure 6:
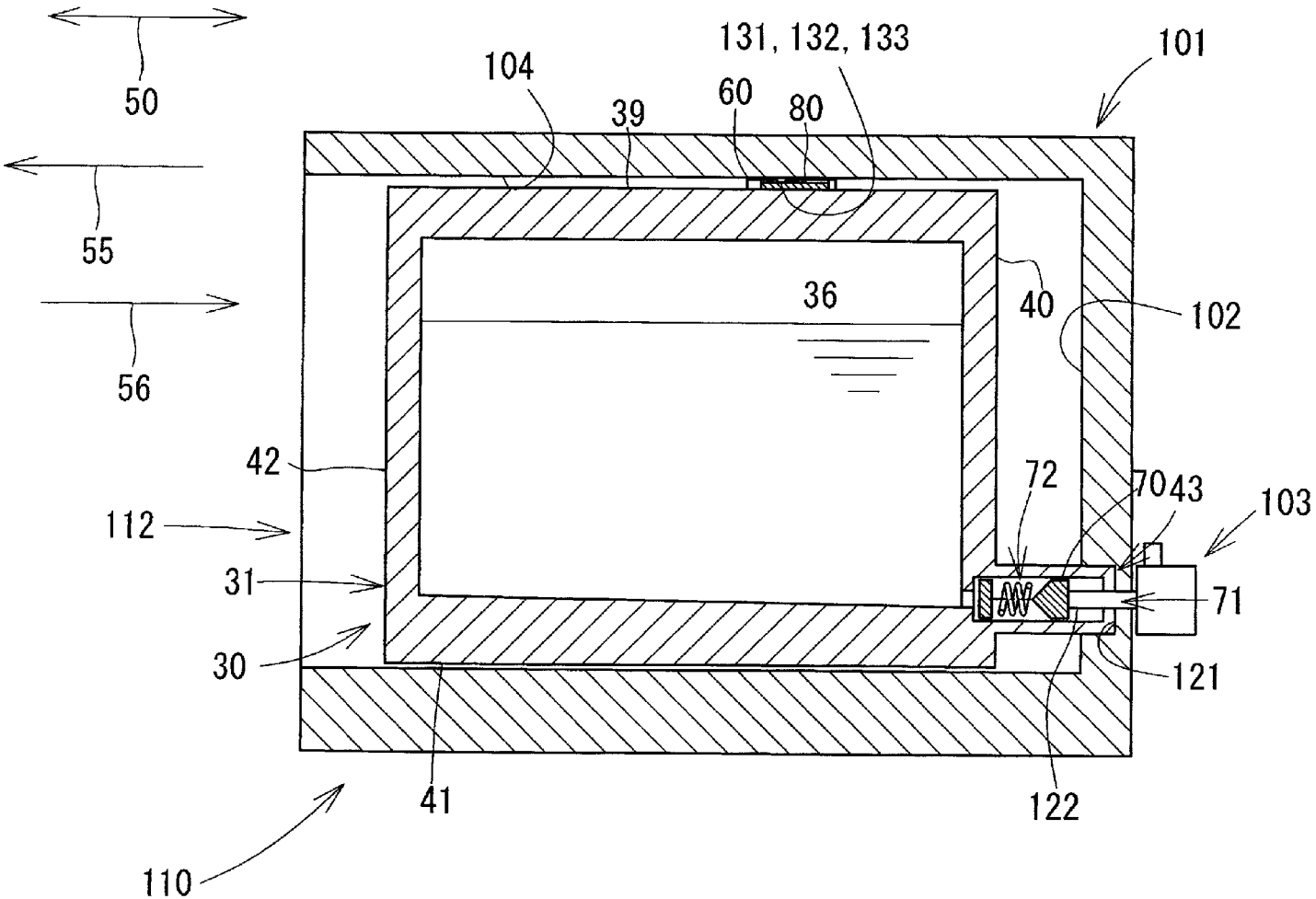
FIG. 6 is a cross-sectional view depicting a cartridge mount and an ink cartridge mounted in the cartridge mount according to an embodiment of the invention.

Referring to FIG. 2, ink cartridge 30 may be a container configured to store ink therein. Ink cartridge 30 may have a space formed therein that may serve as an ink chamber 36, as shown in FIG. 6, for storing ink, e.g., imaging material. Ink chamber 36, e.g., a chamber, may be defined by and contained within a main body 31. In another embodiment, ink chamber 36 may be defined by a member other than main body 31.

Figure 5:
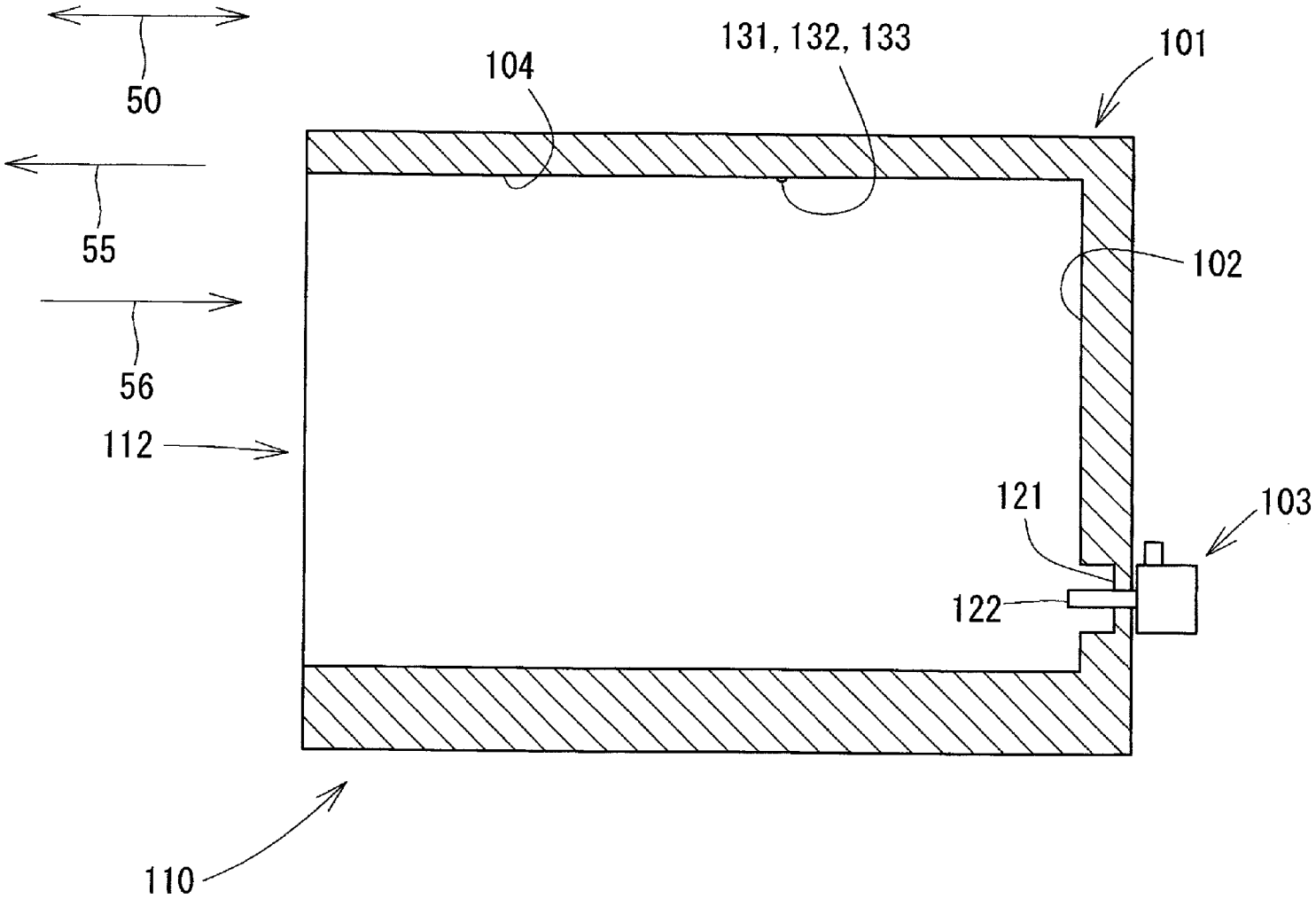
FIG. 5 is a cross-sectional view depicting a cartridge mount according to an embodiment of the invention.

Ink cartridge 30 may be inserted into or removed from cartridge mount 110 in insertion and removal directions 50, as depicted in FIG. 6. Ink cartridge 30 may be inserted into cartridge mount 110 along an insertion direction 56, as depicted in FIG. 5, and may be removed from cartridge mount 110 along a removal direction 55, as depicted in FIG. 5. Insertion direction 56 may be the direction in which ink cartridge 30 may be inserted into cartridge mount 110, and removal direction 55 may be the direction in which ink cartridge 30 may be removed from cartridge mount 110. A height direction 52 of ink cartridge 30 may be parallel to a direction of gravity.

Main body 31 may have a substantially rectangular parallelepiped shape. Main body 31 may have a relatively thin-walled body in which a dimension in height direction 52 and a dimension in a length direction 53 may be greater than a dimension in a width direction 51. A front wall 40, e.g., a front surface, may define a front portion of main body 31 with respect to insertion direction 56, and a rear wall 42, e.g., a rear surface, may define the rear of main body 31 with respect to insertion direction 56. Front wall 40 and rear wall 42 may be disposed opposite to each other in length direction 53. Main body 31 may be defined by front wall 40, rear wall 42, an upper wall 39, and a lower wall 41. Upper wall 39 may extend between and connect an upper edge of front wall 40 and an upper edge of rear wall 42. Lower wall 39 may extend between and connect a lower edge of front wall 40 and a lower edge of rear wall 42. A pair of side walls 37 and 38 may be spaced from each other in width direction 51 and may connect to edges of upper wall 39, front wall 40, lower wall 41, and rear wall 42. Insertion and removal direction 50 may be parallel to length direction 53. Insertion and removal direction 50 may be perpendicular to front wall 40 of main body 31.

Main body 31 may comprise an ink outlet portion 43, e.g., an imaging material outlet portion, disposed at front wall 40, e.g., a first surface of the main body. Ink outlet portion 43 may be disposed in the lower portion of main body 31 at a position lower than a middle position of front wall 40 in height direction 52. Ink outlet portion 43 may be cylindrical in its outer shape and may protrude outward from front wall 40 along length direction 53. A protruding end of ink outlet portion 43 may have an ink outlet port 71.

As depicted in FIG. 6, ink outlet portion 43 may have an ink channel 72 formed therein. Ink channel 72 may extend from ink outlet port 71 to ink chamber 36 via, an internal space of ink outlet portion 43 along length direction 53 and may place ink chamber 36 in fluid communication with ink outlet portion 71. An ink outlet valve 70 may be disposed in ink channel 72 and configured to selectively open and close ink outlet port 71. When ink cartridge 30 is mounted to cartridge mount 110, a hollow tube 122 of cartridge mount 110 may enter ink outlet port 71 to open ink outlet valve 70. Thus, ink may flow from ink chamber 36 into hollow tube 122 of cartridge mount 110 through ink channel 72.

In another embodiments, ink outlet port 71 may be sealed with a film or a rubber stopper. When ink cartridge 30 is mounted to cartridge mount 110, hollow tube 122 may penetrate the film or the rubber stopper to open ink outlet port 71.

Figure 3:
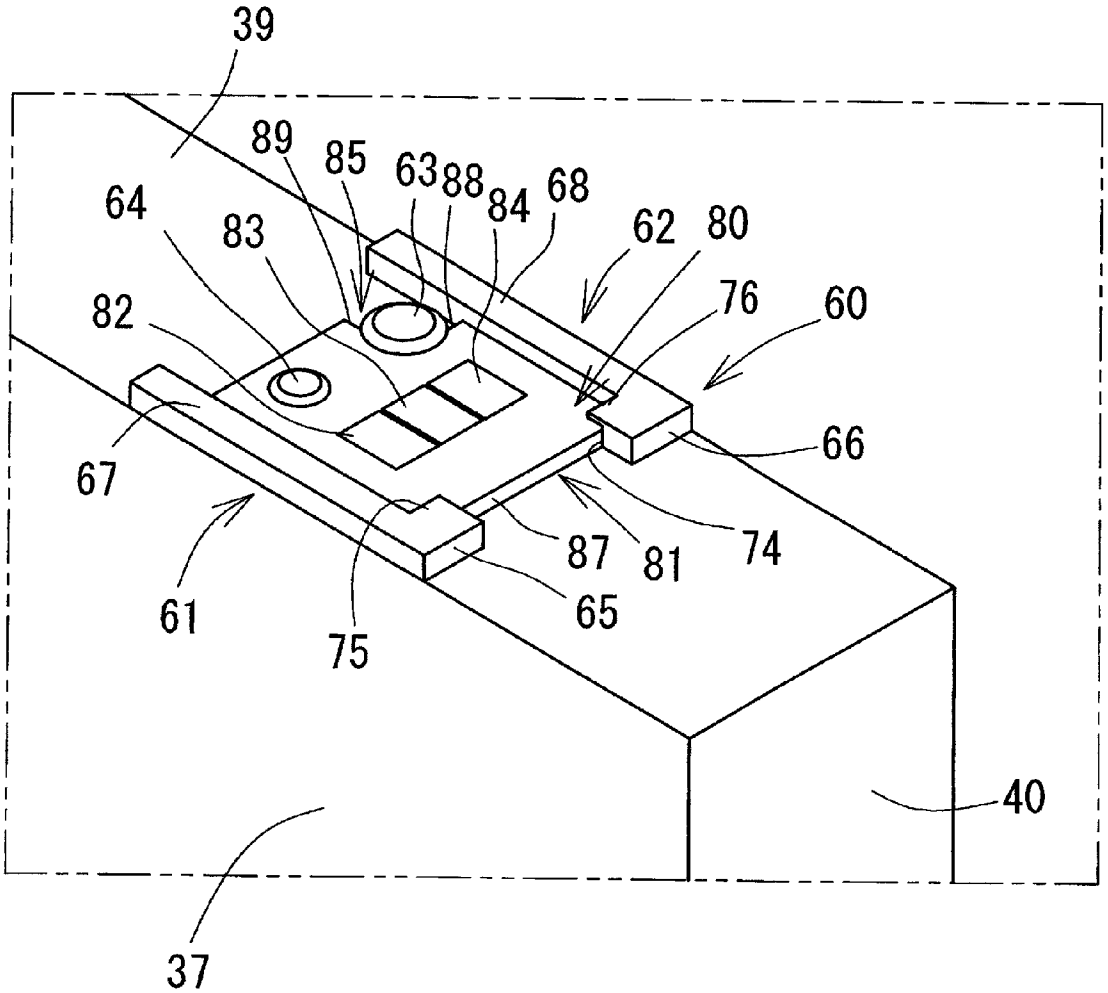
FIG. 3 is an enlarged view depicting an IC substrate affixed to the ink cartridge according to the embodiment of the invention depicted in FIG. 2.

As depicted in FIGS. 2 and 3, a substrate support 60 may be disposed on upper wall 39, e.g., a support surface, of main body 31. Substrate support 60 may be positioned closer to front wall 40 than the middle position bisecting upper wall 39 between front wall 40 and rear wall 42. Substrate support 60 may comprise ridges 61 and 62, e.g., a first protrusion, and bosses 63 and 64, e.g., a second protrusion. Ridges 61 and 62 may protrude from an outer surface, which may be defined by upper wall 39 as a support surface, in a direction from the support surface. Bosses 63 and 64 may protrude from upper wall 39 and may be disposed at respective positions in substrate support 60 closer to rear wall 42 than that at which ridges 61 and 62 are positioned. Bosses 63 and 64 may be melted by heating to fasten an IC substrate 80.

Ridges 61 and 62 may have symmetrical shapes with respect to a center line extending along length direction 53 and through a center of upper wall 39 in width direction 51. Each of ridges 61 and 62 may have a rib-like shape. Ridge 61 may comprise a first portion 65 elongated along width direction 51 and a second portion 67 elongated along length direction 53. First portion 65 and second portion 67 may be connected to each other. First portion 65 of ridge 61 may have a surfaces 73 facing IC substrate 80. Ridge 62 may comprise a first portion 66 elongated along width direction 51 and a second portion 68 elongated along length direction 53. First portion 66 and second portion 68 may be connected to each other. First portion 66 of ridge 62 may have surfaces 74 facing IC substrate 80.

Flat surfaces 73 and 74, e.g., a first surface of a first protrusion, may face toward rear wall 42 and extend along width direction 51 and height direction 52. Flat surfaces 73 and 74 may extend along a direction orthogonal to a direction that the outer surface, e.g., the support surface, of upper wall 39 extends.

Ridges 61 and 62 may be separated from each other in width direction 51. A distance between ridges 61 and 62 may be greater than a width of IC substrate 80 including electrodes 82, 83, and 84 in width direction 51. Ridges 61 and 62 respectively may be disposed outside the outermost ones of electrodes 82, 83, 84 in width direction 51 when IC substrate 80 is supported by substrate support 60.

The height of ridges 61 and 62 from upper wall 39 may be greater than a thickness of IC substrate 80 in height direction 52. First portions 65 and 66 of ridges 61 and 62 may comprise flanges 75 and 76 at their upper edges, respectively. Flanges 75 and 76 may extend parallel to upper wall 39 toward rear wall 42. Flanges 75 and 76 may protrude from the respective upper edges of first portions 65 and 66 toward rear wall 42. Therefore, flanges 75 and 76 may cover a forward portion of IC substrate 80 when IC substrate 80 is supported by substrate support 60.

Second portions 67 and 68 of ridges 61 and 62 may protrude upward along and from respective side walls 37 and 38 of main body 31, A distance between second portions 67 and 68 may be greater than the width of IC substrate 80 with respect to width direction 51. Each of second portions 67 and 68 may have a length greater than a length of IC substrate 80 in length direction 53. IC substrate 80 may fit between second portions 67 and 68 when IC substrate 80 contacts flat surfaces 73 and 74 of first portions 65 and 66.

Figure 4:
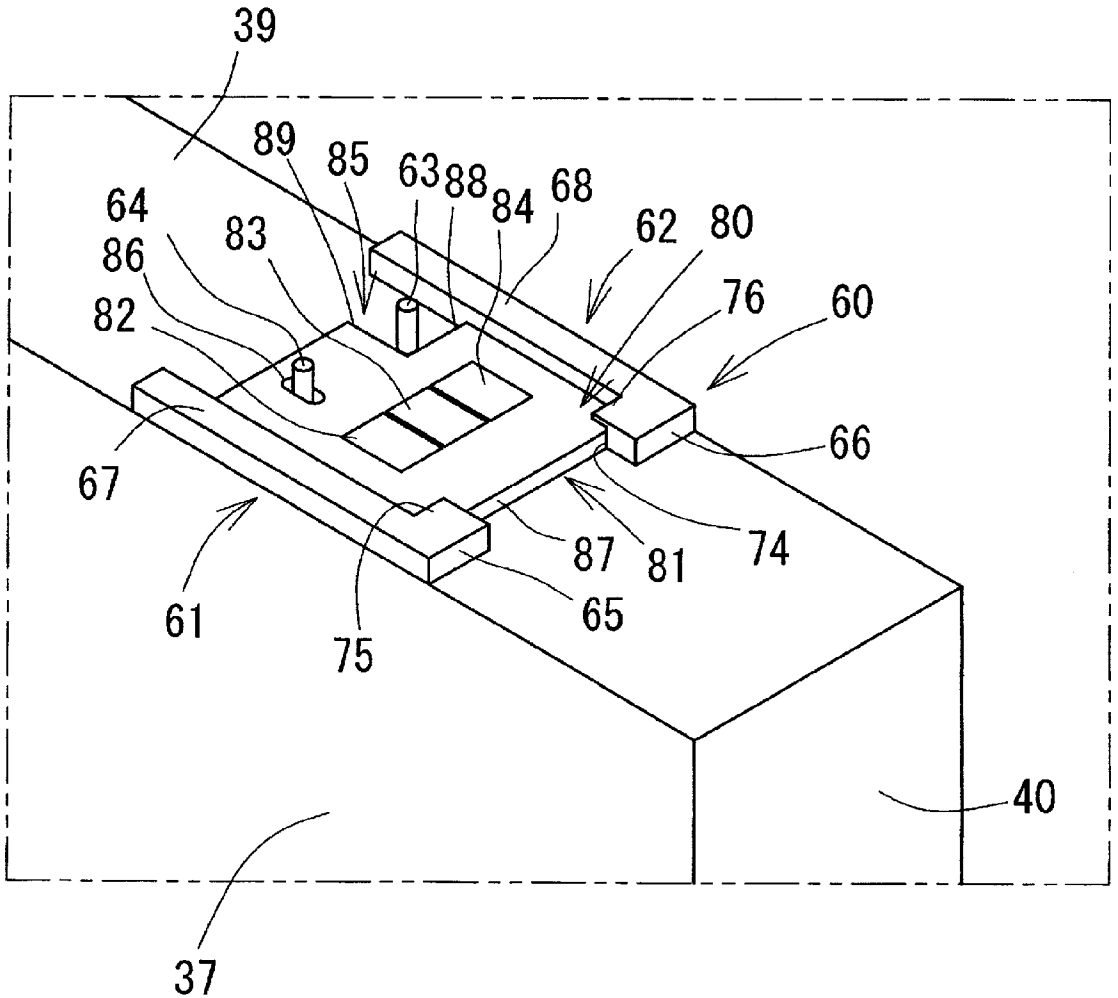
FIG. 4 is an enlarged view depicting the IC substrate of FIG. 3 before an IC substrate is affixed to the ink cartridge according to the embodiment of the invention depicted in FIG. 2.

As depicted in FIGS. 3 and 4, bosses 63 and 64 may be disposed between second portions 67 and 68 of ridges 61 and 62 and at positions closer to rear wall 42 than those of first portions 65 and 66 in length direction 53. Bosses 63 and 64 may be separated from each other in width direction 51. Bosses 63 and 64 may comprise a resin that may melt when heated and may re-solidify when cooled. As depicted in FIG. 4, bosses 63 and 64 may be cylindrical members protruding from upper wall 39 before application of heat. By applying heat to exposed ends of bosses 63 and 64, the material of bosses 63 and 64 may melt and spread on an upper surface of IC substrate 80 and then may re-solidify when cooled, as depicted in FIG. 3.

IC substrate 80 may be disposed on upper wall 39 of main body 31 and supported by substrate support 60. An electrical connection may be established between IC substrate 80 and contacts 131, 132 and 133, as depicted in FIG. 6, during the mounting of ink cartridge 30 to cartridge mount 110. The electrical connection may be maintained when ink cartridge 30 is mounted in cartridge mount 110. IC substrate 80 may correspond to an electrical interface between ink cartridge 30 and cartridge mount 110.

IC substrate 80 may comprise a HOT electrode 82, a GND electrode 83, and a signal electrode 84 on an upper surface of a circuit board 81. IC substrate 80 may also comprise an IC circuit formed on a lower surface of circuit board 81. The IC may be a semiconductor integrated circuit and may be configured to store data indicating information about ink cartridge 30, e.g., one or more of a lot number, a date of manufacture, and ink color. The data stored in the IC may be read out by printer 10.

Circuit board 81 may be a rectangular plate in plan view having four side surfaces, e.g., a first through a fourth side-surfaces. The first, second, third and fourth side-surfaces may be referred to as a front, rear, right and left side-surfaces, respectively. Each of the side surfaces may extend in a direction orthogonal to the upper surface of circuit board 81. HOT electrode 82, GND electrode 83, and signal electrode 84 may be arranged on the upper surface of circuit board 81 in width direction 51. HOT electrode 82, GND electrode 83, and signal electrode 84 may be electrically connected with the IC. HOT electrode 82, GND electrode 83, and signal electrode 84 may be elongated along length direction 53 and may be separated from each other in width direction 51.

Referring to FIG. 4, circuit board 81 may comprise a notch 85 and a slot 86, e.g., openings, at positions closer to rear wall 42 than those at which HOT electrode 82, GND electrode 83 and signal electrode 84 are positioned in length direction 53. Circuit board 81 may be partially cut away or penetrated in its thickness direction to define notch 85 and slot 86, e.g., a hole. Notch 85 and slot 86 may be separated from each other in width direction 51.

A corner of circuit board 81, which comprises two adjoining edges extending along width direction 51 and length direction 53, respectively, may be cut away form notch 85. Notch 85 may be defined by the intersection of a flat surface 88, e.g., a second surface of the circuit board, and a fiat surface 89, e.g., a third surface of the circuit board. Flat surface 88 may extend parallel to a front side-surface 87, e.g., a first surface of the circuit board, that extends in the thickness direction of IC substrate 80. Flat surface 89 may extend parallel to the right and left side-surfaces of circuit board 81.

Slot 86 may be formed in circuit board 81 on the side of circuit board 81 opposite from the side at which notch 85 is formed in width direction 51. Slot 86 may be a through hole elongated in length direction 53. A dimension of slot 86 in width direction 51 may be slightly greater than an outside diameter of umelted boss 64.

As depicted in FIG. 4, IC substrate 80 may be disposed between ridges 61 and 62 in which front side-surface 87 of circuit board 81 may contact flat surfaces 73 and 74 of first portions 65 and 66 of ridges 61 and 62. Flat surfaces 73 and 74 may extend along front side-surface 87, and front side-surface 87 of circuit board 81 may contact flat surfaces 73 and 74. This configuration may position circuit board 81, such that circuit board 81 may not rotate on upper wall 39 about an axis parallel to height direction 52.

Front side-surface 87 of circuit board 81 may be exposed in a middle portion of upper wall 39 in width direction 51. The middle portion may not be covered by ridges 61 and 62. Front side-surface 87 may contact first portions 65 and 66 of ridges 61 and 62 at its outer portions in width direction 51. A width of the exposed area of front side-surface 87, e.g., the distance between first portions 65 and 66, may be set, such that contacts 131, 132 and 133 may not contact first portions 65 and 66 during the mounting of ink cartridge 30 to cartridge mount 110.

To place circuit board 81 in substrate support 60, first, front side-surface 87 of circuit board 81 may contact flat surfaces 73 and 74 while a rearward part, e.g., a part closer to rear wall 42, of circuit board 81 may be separated from upper wall 39, and then the rearward part of circuit board 81 may be placed, e.g., pivoted, down onto upper wall 39. By doing so, boss 63 may be disposed in notch 85 of circuit board 81 and boss 64 may be disposed in slot 86 of circuit board 81. Under this condition, circuit board 81 may be movable along a direction parallel to width direction 51 within a gap between notch 85 and boss 63 and a gap between slot 86 and boss 64 along flat surfaces 73 and 74. Bosses 63 and 64 may have a height greater than the thickness of circuit board 81 and, thus, may protrude through circuit board 81 from upper wall 39. When the ends of bosses 63 and 64 are melted, the melted end of the respective boss may enter the gap between notch 85 and boss 63 and the gap between slot 86 and boss 64 and may overflow to spread on at least a portion of circuit board 81. The gap between notch 85 and boss 63 and the gap between slot 86 and boss 64 may be filled with the melted end of the respective one of bosses 63 and 64. By cooling with natural air after heating, the melted ends of bosses 63 and 64 may be contact the surface of circuit board 81 like a brim. Circuit board 81 may be fixed to upper wall 39 by the melting and cooling steps described above and the contact made between front side-surface 87 and flat surfaces 73 and 74.

As depicted FIG. 5, cartridge mount 110 may comprise a case 101 serving as a housing. Case 101 may have a box shape having opening 112 in the front side of printer 10. Ink cartridge 30 may selectively be inserted into and removed from case 101 via opening 112. Case 101 may be configured to accommodate a plurality of, e.g., four, ink cartridges 30 of a plurality of colors, e.g., cyan, magenta, yellow, and black, respectively.

Case 101 may have a side inner surface 102 at a side opposite from opening 102 in insertion and removal direction 50. Side inner surface 102 may define a portion of an internal space of case 101. Connectors 103 may be disposed at a lower part of side inner surface 102 of case 101. Connectors 103 may be disposed at side inner surface 102 at respective positions that may correspond to ink outlet portions 43 of respective ink cartridges 30 placed in case 101.

Each connector 103 may comprise hollow tube 122 and a holding portion 121. Each of hollow tubes 122 may be connected with its respective ink tube 20 at an outer surface that opposite from side inner surface 102 of case 101. Ink tubes 20 may be connected with respective hollow tubes 122 to allow ink to flow to recording head 21 of printer 10.

Each holding portion 121 may be a cylindrically recessed portion formed in side inner surface 102 of case 101. Each hollow tube 122 may be disposed at a substantially middle portion of holding portion 121 in insertion and removal direction 50. As depicted in FIG. 6, when ink cartridge 30 is mounted to cartridge mount 110, ink outlet portion 43 having a cylindrical shape may be inserted into cylindrical holding portion 121. In this configuration, a circumference of ink outlet portion 43 may tightly contact a surface defining holding portion 121. When ink outlet portion 43 is inserted into holding portion 121, hollow tube 122 may be inserted into ink outlet port 71 of ink outlet portion 43, and hollow tube 122 may move ink outlet valve 70. Thus, ink outlet valve 70 positioned in a closed position may move to an open position against an urging force from a coil spring 73, and, therefore, ink stored in ink chamber 36 may flow to the outside of ink cartridge 30. Ink from ink chamber 36 may flow into hollow tube 122 and further into recording head 21 via ink tube 20 due to the pressure head differential between ink chamber 36 and recording head 21.

As depicted in FIG. 5, case 101 may comprise contacts 131, 132, and 133 disposed on an upper inner surface 104 of case 101 at a position between side inner surface 102 and opening 112 in insertion and removal direction 50. Contacts 131, 132, and 133 may be separated from each other in a direction orthogonal to insertion and removal direction 50. Contacts 131, 132, and 133 also may be disposed so as to correspond to HOT electrode 82, GND electrode 83, and signal electrode 84 of ink cartridge 30, respectively.

Contacts 131, 132, and 133 may be electrically connected with a controller. The controller may comprise, for example, a central-processing unit ("CPU"), a read-only memory a random-access memory ("RAM") and may be configured as a control device of printer 10. Contact 131 may be used to apply voltage Ye to HOT electrode 82 by establishing electrical connection with HOT electrode 82. Contact 132 may be used to allow GND electrode 83 to establish a ground by establishing electrical connection with GND electrode 83. Contacts 131 and 132 may be used to supply power to circuit board 81 by establishing electrical connection with HOT electrode 82 and GND electrode 83, respectively. Contact 133 may be used to access data stored in circuit board 81 by establishing electrical connection with signal electrode 84.

As depicted in FIG. 6, during the mounting of ink cartridge 30 to cartridge mount 110, HOT electrode 82, GND electrode 83, and signal electrode 84 of IC substrate 80 may contact respective contacts 131, 132, and 133 at a predetermined timing, and electrical connection may be established therebetween. More specifically, during the mounting of ink cartridge 30 to cartridge mount 110, contacts 131, 132, and 133 may pass between first portions 65 and 66 of ridges 61 and 62 and may contact front side-surface 87 of circuit board 81 or an upper edge of front side-surface 87. Contacts 131, 132, and 133 then may move rearward relative to ink cartridge 30 while sliding over the upper surface of circuit board 81, and may be electrically connected with HOT electrode 82, GND electrode 83, and signal electrode 84, respectively. As described above, in substrate support 60, ridges 61 and 62 may be disposed outside the outermost ones of HOT electrode 82, GND electrode 83, and signal electrode 84, respectively, of IC substrate 80 in width direction 51. Accordingly, contacts 131, 132, 133 may contact with HOT electrode 82, GND electrode 83, and signal electrode 84, respectively, without contacting ridges 61 and 62.

According to the above-described embodiment, circuit board 81 of IC substrate 80 may be positioned so as not to rotate on upper wall 39 by which front side-surface 87 may contact ridges 61 and 62. Circuit board 81 may be affixed to upper wall 39 by bosses 63 and 64, which may be received into notch 85 and slot 86, respectively, and may be melted by heating and then cooled. Thus, IC substrate 80 may be securely positioned and affixed accurately to main body 31.

Ridges 61 and 62 may comprise flat surfaces 73 and 74, respectively, that may extend along front side-surface 87 of circuit board 81. Accordingly, the positioning of circuit board 81 may be accomplished by the surface contact between flat surfaces 73 and 74 and front side-surface 87.

Ridges 61 and 62 may contact front side-surface 87 of circuit board 81 at the positions outside the outermost ones of electrodes 82, 83 and 84 in width direction 51. Accordingly, during the mounting of ink cartridge 30 to cartridge mount 110, contacts 131, 132, and 133 may have contact electrodes 82, 83, and 84 without contacting ridges 61 and 62. Because contacts 131, 132, and 133 may not contact ridges 61 and 62 during the mounting of ink cartridge 30 to cartridge mount 110, the operation load during the mounting of ink cartridge 30 to cartridge mount 110 may be reduced.

Figure 7:
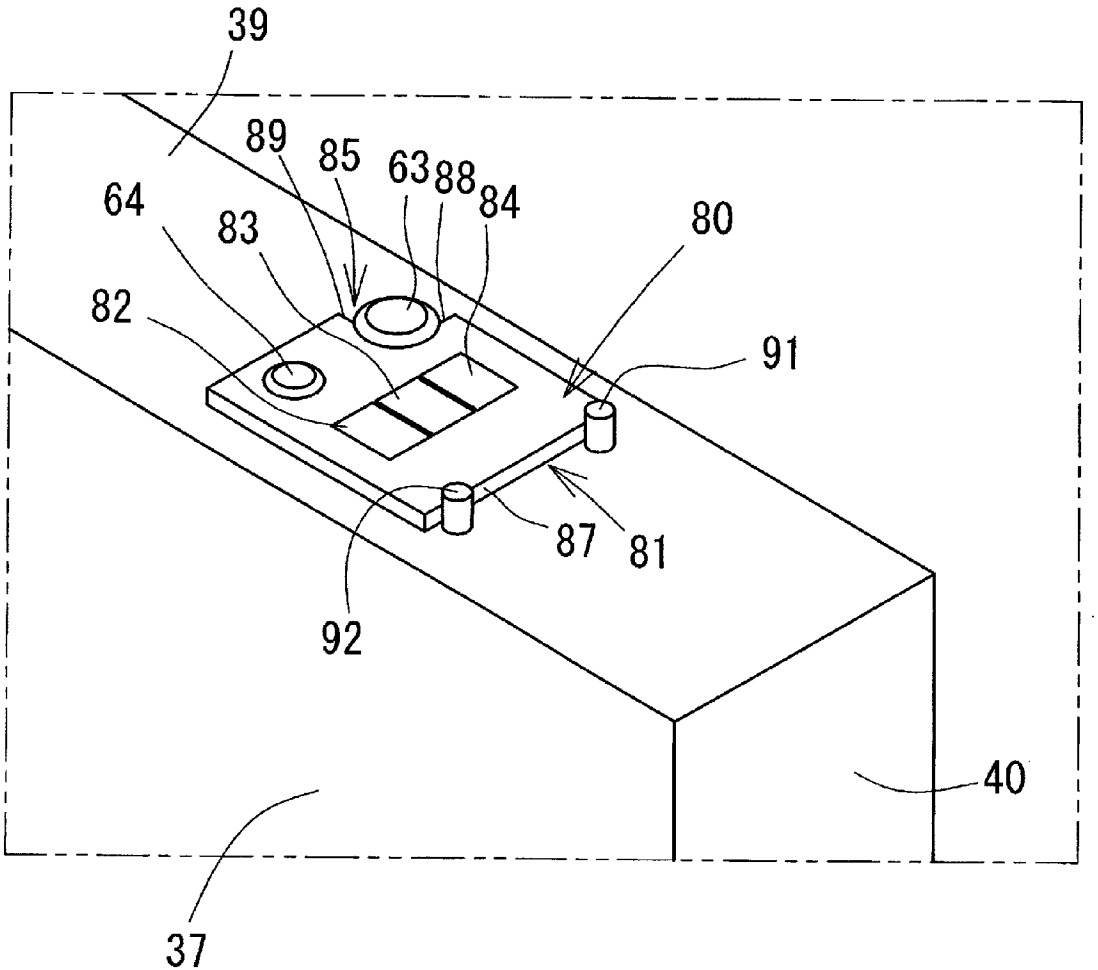
FIG. 7 is a perspective view of an IC substrate affixed to a cartridge according to another embodiment of the invention.

Circuit board 81 may be positioned, such that front side-surface 87 of circuit board 81 and flat surfaces 73 and 74 of ridges 61 and 62 may have surface contact therebetween. Consequently, circuit board 81 may not rotate on upper wall 39. In another embodiment, as depicted in FIG. 7, bosses 91 and 92, each having a cylindrical shape, may be disposed on upper wall 39, instead of ridges 61 and 62 having flat surfaces 73 and 74. In this embodiment, front side-surface 87 may contact curved surfaces of bosses 91 and 92 at two points. Moreover, when front side-surface 87 of circuit board 81 and flat surfaces 73 and 74 of ridges 61 and 62 have surface contact therebetween, flanges 75 and 76 or second portions 67 and 68 may be omitted.

Front side-surface 87 of circuit board 81 may contact ridges 61 and 62. In another embodiment, one of the right and left side-surfaces of circuit board 81 and one of ridges 61 and 62 may have surface contact or one of the right and left side-surfaces of circuit board 81 and bosses 91 and 92 may have point contact. At least one of front side-surface 87 and ridges 61 and 62 may have a flat surface. Both of bosses 63 and 64 may be melted by heating and may re-solidify when cooled. In another embodiment, one of bosses 63 and 64 may be melted by heating and cooled. Boss 64 inserted into slot 86 may be melted by heating and cooled, and boss 63 may contact flat surfaces 88 and 89 defining notch 85. In this case, boss 63 may serve as a rotation stopper for regulating the rotation of circuit board 81. In still another embodiment, boss 63 positioned in notch 85 may be melted by heating and cooled, and boss 64 inserted into slot 86 may serve as the rotation stopper.

Ink cartridge 30 may comprise an ink remaining amount detecting portion. The ink remaining amount detecting portion may be disposed to protrude from front wall 40 of ink cartridge 30 in a direction away from ink chamber 36. The ink remaining amount detecting portion may be formed of transparent resin. A remaining amount of ink in ink chamber 36 may be inspected through the ink remaining amount detecting portion or an optical sensor may detect the remaining amount of ink through ink remaining amount detecting portion. When the optical sensor is used to detect the remaining amount of ink in ink chamber 36, a distance between a pair of side walls constituting the ink remaining amount detecting portion may be less than a distance between a light-emitting element and a light-receiving element of the optical sensor. A light shield configured to move in accordance with the amount of ink stored in ink chamber 36 may be provided in ink remaining amount detecting portion. Instead of the light shield, ink cartridge 30 may be configured, such that all or part of light emitted from the light-emitting element may be reflected, diffracted, or otherwise attenuated to reduce an amount of light that may reach the light-receiving element in accordance with the amount of ink stored in ink chamber 36.

Ink as printing liquid may be stored in ink cartridge 30 for inkjet-type printer 10. In another embodiment, a cartridge that may store toner as printing liquid for an electrophotographic-type, image forming apparatus.

Main body 31 may have a rectangular parallelepiped shape. In another embodiment, main body 31 may comprise a plurality of members, e.g., rectangular parallelepiped members, including a bracket that may cover a portion of each member for storing ink. In this embodiment, IC substrate 80 may be disposed on the bracket.

IC substrate 80 may be disposed on upper wall 39 of main body 31. In another embodiment, IC substrate 80 may be disposed on another wall and disposed between front wall 40 and rear wall 42 of main body 31. For example, IC substrate 80 may be disposed on one of side surfaces 37 and 38 of main body 31. Upper wall 39 of main body 31 may comprise a raised portion at upper wall 39 of main body 31, and IC substrate 80 may be disposed on an upper surface, as the support surface, of the raised portion. In this embodiment, bosses 63 and 64 and ridges 61 and 62 may protrude from the support surface of the raised portion or protrude from upper wall 39.

The combination of notch 85 and slot 86 may be provided as an example of a pair of openings and notches. In another embodiment, the pair of an opening and a notch may be a pair of openings or a pair of notches.

Notch 85 and slot 86 may be disposed behind electrodes 82, 83, and 84 in length direction 53. In another embodiment, the pair of openings and notches may be disposed in front of electrodes 82, 83, and 84 in length direction 53. In another embodiment, notch 85 may have a semicircular shape cut away from one of the side surfaces of circuit board 81.

While the invention has been described in connection with various exemplary structures and illustrative embodiments, it will be understood by those skilled in the art that other variations and modifications of the structures, configurations, and embodiments described above may be made without departing from the scope of the invention. For example, this application may comprise many possible combinations of the various elements and features disclosed herein, and the particular elements and features presented in the claims and disclosed above may be combined with each other in other ways within the scope of the application, such that the application should be recognized as also directed to other embodiments comprising other possible combinations. Other structures, configurations, and embodiments will be apparent to those skilled in the art from a consideration of the specification or practice of the invention disclosed herein. It is intended that the specification and the described examples are illustrative with the true scope of the invention being defined by the following claims.

What is claimed is:

1. A cartridge comprising:

a main body having a chamber formed therein and configured to receive an imaging material;

a circuit board having a hole and a notch formed through the circuit board; and an electrode disposed on the circuit board, wherein the main body comprises:

a support surface configured to support the circuit board;

a first protrusion protruding from the support surface and configured to contact a first surface of the circuit board, wherein the first surface of the circuit board extends in a direction away from the support surface;

a second protrusion protruding from the support surface and disposed in the hole, wherein the second protrusion comprises an end portion that covers a portion of the circuit board; and a third protrusion protruding from the support surface and disposed in the notch.

2. The cartridge according to claim 1 further comprising an imaging material outlet portion protruding from a first surface of the main body and configured to communicate the chamber of the main body with an exterior of the main body, wherein the electrode of the circuit board is disposed between the second protrusion and the imaging material outlet portion in a direction in which the imaging material outlet portion protrudes from the first surface of the main body.

3. The cartridge according to claim 1 further comprising an imaging material outlet portion protruding from a first surface of the main body and configured to communicate the chamber of the main body with an exterior of the main body, wherein the first protrusion is disposed between the circuit board and the imaging material outlet portion in a direction in which the imaging material outlet portion protrudes from the first surface of the main body.

4. The cartridge according to claim 1, wherein the first protrusion comprises a first surface parallel to and contacting the first surface of the circuit board.

5. The cartridge according to claim 1, wherein the at least one opening comprises a hole elongated in a direction perpendicular to the first surface of the circuit board and a notch.

6. The cartridge according to claim 5, wherein the notch is defined at least by a second surface of the circuit board parallel to the first surface of the circuit board and a third surface of the circuit board perpendicular to the first surface of the circuit board and to the support surface of the main body.

7. The cartridge according to claim 5, wherein the second protrusion contacts one of the hole and the notch to restrict the circuit board from rotating on the support surface.

8. The cartridge according to claim 1 further comprising a plurality of electrodes positioned in the circuit board and arranged in a row extending in a direction parallel to the first surface of the circuit board and to the support surface of the main body.

9. The cartridge according to claim 8, wherein the first protrusion does not overlap the row of the plurality of electrodes in a direction perpendicular to the first surface of the circuit board.

10. The cartridge according to claim 1, wherein the main body further comprises a bracket and the support surface is disposed on the bracket.

11. A cartridge comprising:

a main body having a chamber formed therein and configured to receive an imaging material;

a circuit board having a hole and a notch formed through the circuit board; and an electrode disposed on the circuit board, wherein the main body comprises:

a support surface configured to support the circuit board;

an imaging material outlet portion disposed at a first surface of the main body perpendicular to the support surface and configured to communicate the chamber of the main body with an exterior of the main body;

a first protrusion protruding from the support surface and configured to contact a first surface of the circuit board, wherein the first surface of the circuit board extends in a direction perpendicular to the support surface;

a second protrusion protruding from the support surface and disposed in the hole, wherein the second protrusion comprises an end portion that covers a portion of the circuit board, a third protrusion protruding from the support surface and disposed in the notch, wherein the electrode of the circuit board is disposed between the second protrusion and the imaging material outlet portion in a direction in which the imaging material outlet portion protrudes from the first surface of the main body, wherein the first protrusion is disposed between the circuit board and the imaging material outlet portion in the direction in which the imaging material outlet portion protrudes from the first surface of the main body, wherein the first protrusion comprises a first surface parallel to and contacting the first surface of the circuit board, wherein the cartridge further comprises a plurality of electrodes positioned in the circuit board and arranged in a row extending in a direction parallel to the first surface of the circuit board and to the support surface of the main body, and wherein the first protrusion does not overlap the row of the plurality of electrodes in a direction perpendicular to the first surface of the circuit board.

12. A method for affixing a circuit board to a support surface of a cartridge, the method comprising:

positioning the circuit board on the support surface adjacent to a first protrusion on the support surface, such that a second protrusion disposed on the support surface is positioned in an opening of the circuit board;

moving the circuit board toward the first protrusion, such that the circuit board contacts the first protrusion; and heating a portion of the second protrusion to melt the portion of the second protrusion, such that the melted portion of the second protrusion contacts a surface of the circuit board.

* * * * *